US007124875B2

(12) United States Patent
Ogura et al.

(10) Patent No.: US 7,124,875 B2
(45) Date of Patent: Oct. 24, 2006

(54) ESCALATOR WITH HIGH SPEED INCLINED SECTION

(75) Inventors: Manabu Ogura, Toky (JP); Takashi Yumura, Tokyo (JP); Joichi Nakamura, Fukuoka (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 95 days.

(21) Appl. No.: 10/268,804

(22) Filed: Oct. 11, 2002

(65) Prior Publication Data

US 2003/0136634 A1 Jul. 24, 2003

(30) Foreign Application Priority Data

Jan. 23, 2002 (JP) ..... 2002-014663

(51) Int. Cl.
*B66B 21/12* (2006.01)

(52) U.S. Cl. ..... 198/334; 198/326; 198/332

(58) Field of Classification Search ..... 198/326, 198/332, 334

See application file for complete search history.

(56) References Cited

U.S. PATENT DOCUMENTS 899,933 A * 9/1908 Wheeler ..... 198/332
1,071,529 A * 8/1913 Seeberger ..... 198/332
5,115,899 A * 5/1992 Nakatani ..... 198/334
6,588,573 B1 * 7/2003 Ogura et al. ..... 198/334
6,591,959 B1 * 7/2003 Ogura et al. ..... 198/334
6,675,949 B1 * 1/2004 Gonzalez Alemany et al. ..... 198/334
6,796,416 B1 * 9/2004 Ogura et al. ..... 198/334
6,832,678 B1 * 12/2004 Ogura et al. ..... 198/322

FOREIGN PATENT DOCUMENTS

| | | |
|---|---|---|
| EP | 0 243 572 | 11/1987 |
| EP | 1 253 101 | 8/2003 |
| JP | 51-116586 | 10/1976 |
| JP | 2001-348179 | 12/2001 |
| WO | WO 200136311 A1 * | 5/2001 |

OTHER PUBLICATIONS http://m.-w.com/cgi-bin/dictionary?book=Dictionary&va=transverse.*
http://www.askoxford.com/concise_oed/tread?view=uk.*

* cited by examiner

*Primary Examiner*—Douglas A. Hess
(74) *Attorney, Agent, or Firm*—Leydig, Voit & Mayer, Ltd.

(57) ABSTRACT

An escalator with a high speed inclined section, includes link mechanisms, each of which has a first link with a first end rotatably connected to a step link roller shaft, and a second link, a first end of which is rotatably connected to a middle portion of the first link and a second end of which is rotatably connected to a step link roller shaft of an adjacent step. A rotatable auxiliary roller is located at a second end of the first link.

8 Claims, 6 Drawing Sheets

PRIOR ART

ESCALATOR WITH HIGH SPEED INCLINED SECTION

BACKGROUND OF THE INVENTION

1. Field of the Invention

This invention relates to an escalator with a high speed inclined section in which the steps move faster in the intermediate inclined section than in the upper and lower landing sections.

2. Description of the Related Art

Nowadays, a large number of escalators of great height are installed in subway stations or the like. In an escalator of this type, the passenger is obliged to stand on a step for a long period of time, which is often rather uncomfortable. In view of this, a high-speed escalator has been developed. However, in such a high-speed escalator, there is a limitation regarding the traveling speed from the viewpoint of allowing the passengers to get off and on safely.

In view of this, there has been proposed an escalator with a high speed inclined section in which the steps move faster in the intermediate inclined section than in the upper and lower landing sections, whereby it is possible to shorten the traveling time for the passenger. An example of an escalator with a high speed inclined section is disclosed in Japanese Patent Application Laid-Open No. Sho 51-116586.

FIG. 5 is a schematic side view of an example of a conventional escalator with a high speed inclined section. In the drawing, a main frame 1 is provided with a plurality of steps 2 connected together in an endless fashion. The steps 2 are driven by a drive unit 3 to be circulated. The main frame 1 is provided with a pair of main tracks 4 forming a loop track for the steps 2, a pair of trailing tracks 5 for controlling the attitude of the steps 2, and a pair of auxiliary tracks 6 for varying the gap between adjacent steps 2.

The loop track for the steps 2 formed by the main tracks 4 have a forward track section, a return track section, an upper reversing section F, and a lower reversing section I. The forward track section of the loop track includes a horizontal upper landing section (upper horizontal section) A, an upper curved section B, an intermediate inclined section (fixed inclination section) C of a fixed inclination angle, a lower curved section D, a horizontal lower landing section (lower horizontal section) E, an upper transition section G, and a lower transition section H.

The intermediate inclined section C is situated between the upper landing section A and the lower landing section E. The upper curved section B is situated between the upper landing section A and the intermediate inclined section C. The lower curved section D is situated between the lower landing section E and the intermediate inclined section C. The upper transition section G is situated between the upper landing section A and the upper reversing section F. The lower transition section H is situated between the lower landing section E and the lower reversing section I.

Above the steps 2 of the upper and lower landing sections A and E, there are arranged a pair of landing plates 22*a* and 22*b*. The landing plates 22*a* and 22*b* are arranged in the floor portions of the upper and lower landing sections A and E so as to cover the steps 2. Arranged upright above the main frame 1 are a pair of moving handrail devices 23. The moving handrail devices 23 are arranged on either side of the steps 2 with respect to the width direction thereof.

FIG. 6 is a side view showing the portion around the upper landing section A of FIG. 5. Each step 2 has a tread 7 for carrying a passenger, a riser 8 formed by bending the lower end portion of the tread 7, a step link roller shaft 9, a pair of step link rollers 10 rotatable around the step link roller shaft 9, a trailing roller shaft 11, and a pair of trailing rollers 12 rotatable around the trailing roller shaft 11. The step link rollers 10 roll on the main tracks 4. The trailing rollers 12 roll on the trailing tracks 5.

The step link roller shafts 9 of adjacent steps 2 are connected to each other by a pair of link mechanisms (bending links) 13. Each link mechanism 13 has first through fifth links 14 through 18.

One end portion of the first link 14 is rotatably connected to the step link roller shaft 9. The other end portion of the first link 14 is rotatably connected to the middle portion of the third link 16 through a shaft 19. One end portion of the second link 15 is rotatably connected to the step link roller shaft 9 of the adjacent step 2. The other end portion of the second link 15 is rotatably connected to the middle portion of the third link 16 through the shaft 19.

One end portion of the fourth link 17 is rotatably connected to the middle portion of the first link 14. One end portion of the fifth link 18 is rotatably connected to the middle portion of the second link 15. The other end portions of the fourth and fifth links 17 and 18 are connected to one end portion of the third link 16 through a slide shaft 20.

Provided in one end portion of the third link 16 is a guide groove 16*a* for guiding the sliding of the slide shaft 20 in the longitudinal direction of the third link 16. Provided at the other end of the third link 16 is a rotatable auxiliary roller 21. The auxiliary roller 21 is guided by the auxiliary track 6.

When the auxiliary roller 21 is guided by the auxiliary track 6, the shape of the link mechanism 13 is changed and extends and retracts, and the distance between the step link roller shafts 9, that is, the distance between the adjacent steps 2, is varied. In other words, the line of the auxiliary track 6 is designed so that the distance between the adjacent steps 2 varies.

Next, the operation of this conventional escalator will be described. The speed of the steps 2 is varied by varying the distance between the step link roller shafts 9 of the adjacent steps 2. That is, the distance between the step link roller shafts 9 is larger in the intermediate inclined section C than in the upper and lower landing sections A and E where passengers get on or off, whereby the steps 2 move faster in the intermediate inclined section C than in the upper and lower landing sections A and E.

The first, second, fourth, and fifth links 14, 15, 17, and 18 form a so-called pantograph type quadruple link mechanism, and the angle made by the first and second links 14 and 15, with the third link 16 being an axis of symmetry, can be increased or decreased, whereby it is possible to vary the distance between the step link roller shafts 9 connected to the first and second links 14 and 15.

That is, when the distance between the main track 4 and the auxiliary track 6 is diminished, the link mechanism 13 operates like the framework of an umbrella when it is opened, and the distance between the step link roller shafts 9 of the adjacent steps 2 increases.

In the intermediate inclined section C shown in FIG. 5, the distance between the main track 4 and the auxiliary track 6 is minimum, and the distance between the step link roller shafts 9 of the adjacent steps 2 is maximum. Thus, the speed of the steps 2 is maximum. In this condition, the first and second links 14 and 15 are arranged substantially in a straight line.

Further, in the escalator with a high speed inclined section in which the distance between the steps 2 increases in the intermediate inclined section C, the riser 8 downwardly protrudes so as to fill the opening between the adjacent treads 7. When reversing the steps 2 having the risers 8 of this configuration in the reversing sections F and I, the steps 2 will interfere with each other, unless the distance between the steps 2 is increased. Thus, in the reversing sections F and I, the distance between the steps 2 is increased. Accordingly, in the transition sections G and H, an operation to expand the link mechanism 13 is conducted.

However, in the conventional escalator with a high speed inclined section constructed as described above, it is necessary to provide a large number of bearing portions in the link mechanism 13, and the influence of play due to production errors, wear, etc. of the bearing portions is great, so that there is a danger of the distance between the step link roller shafts 9 becoming too large or, conversely, the adjacent steps 2 interfering with each other.

Further, in the conventional escalator with a high speed inclined section, when the operation to expand the link mechanism 13 is conducted in the transition sections G and H, the third link 16 protrudes beyond the height of the landing plates 22*a* and 22*b*. Thus, in an area where the moving handrail device 23 is directly above the link mechanism 13, it is impossible to perform the operation to expand the link mechanism 13. Thus, as shown, for example, in FIG. 7, the distance between the steps 2 starts to increase at a position well on the inner side rather than at an end portion 22*c* of the landing plate 22*a* and 22*b*. As a result, the length of the upper landing section A and that of the lower landing section E become rather large, so that the size of the escalator is rather large.

Further, in the conventional escalator with a high speed inclined section, the auxiliary track 6 exhibits a smooth arcuate configuration in the upper curved section B and the lower curved section D. Thus, the change in the difference in height between the adjacent steps 2 is not completed in the upper curved section B and the lower curved section D, and the change in the difference in height continues in the upper landing section A, the lower landing section E, or the intermediate inclined section C. Thus, as shown, for example, in FIG. 8, the sectional configuration of the riser 8 is discontinuous and bent in the direction of inclination of the intermediate inclined section C; it cannot be formed in a continuous plane or curve, resulting in an increase in production costs.

SUMMARY OF THE INVENTION

This invention has been made with a view toward solving the above-mentioned problems in the prior art. Therefore, it is an object of this invention to provide an escalator with a high speed inclined section in which the number of bearing portions in the link mechanism is reduced to thereby simplify the structure of the link mechanism and in which it is possible to reduce errors in the distance between the step link roller shafts due to production errors and wear of the bearing portions.

To this end, according to one aspect of the present invention, there is provided an escalator with a high speed inclined section, which comprises a plurality of link mechanisms, a rotatable auxiliary roller and an auxiliary track for guiding the movement of the auxiliary roller. Each link mechanism has a first link with one end portion thereof rotatably connected to a step link roller shaft and a second link one end portion of which is rotatably connected to a middle portion of the first link and the other end portion of which is rotatably connected to a step link roller shaft of an adjacent step. The auxiliary roller is provided at the other end of the first link. The angle formed by the first link and the second link is varied and the distance between the step link roller shafts of adjacent steps is varied according to the distance between a main track and the auxiliary track.

In such an escalator, the construction of the link mechanism can be simplified, making it possible to restrain the influence of play due to production errors and wear in the bearing portion and to reduce errors in the distance between the step link roller shafts.

According to another aspect of the present invention, there is provided an escalator with a high speed inclined section in which a step speed changing means is constructed such that in an upper landing section and a lower landing section, a distance between adjacent steps starts to increase immediately after the steps get in under landing plates.

In such an escalator, it is possible to restrain an increase in the length of the upper and lower landing sections, thereby achieving an overall reduction in the escalator size.

According to a still further aspect of the present invention, there is provided an escalator with a high speed inclined section in which a step speed changing means is constructed such that in an upper landing section and a lower landing section, a distance between adjacent steps stops decreasing immediately before the steps get out from under landing plates.

In such an escalator, it is possible to restrain an increase in the length of the upper and lower landing sections, thereby achieving an overall reduction in the escalator size.

According to a still further aspect of the present invention, there is provided an escalator with a high speed inclined section, in which a step speed changing means is constructed such that in a forward track section, a moving speed of steps is varied only in an upper curved section and a lower curved section.

In such an escalator, a riser can be formed as a continuous plane or curved surface, thereby achieving a reduction in production cost.

DETAILED DESCRIPTION OF THE PREFERRED EMBODIMENTS

An embodiment of this invention will now be described with reference to the drawings.

Figure 1:
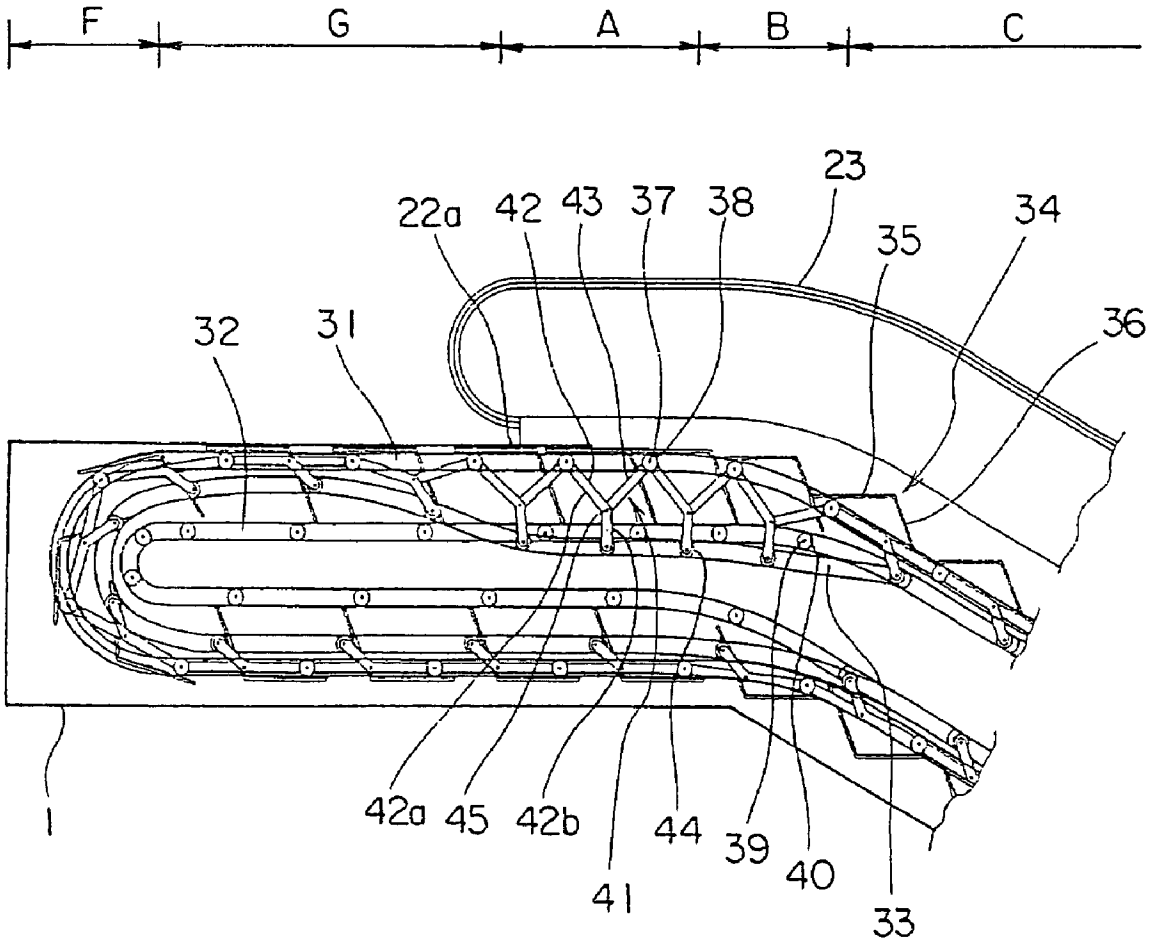
FIG. 1 is a side view showing the portion around the upper reversing section of an escalator with a high speed inclined section according to an embodiment of this invention.

FIG. 1 is a side view showing a portion around an upper reversing section of an escalator with a high speed inclined section according to an embodiment of this invention; FIG.

Figure 3:
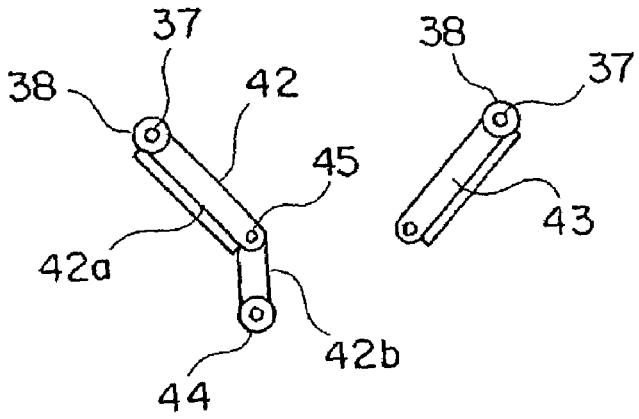
FIG. 3 is an exploded side view of the link mechanism of FIG. 1.

2 is a side view showing a main portion of FIG. 1; and FIG. 3 is an exploded side view of the link mechanism of FIG. 1.

In the drawings, a main frame 1 is provided with a plurality of steps 34 connected together in an endless fashion. The steps 34 are driven by a drive unit 3 (as in the case of FIG. 5), and circulated. The main frame 1 is provided with a pair of main tracks 31 forming a loop track for the steps 34, a pair of trailing tracks 32 for controlling the attitude of the steps 34, and a pair of auxiliary tracks 33 for varying the distance between the adjacent steps 34.

Figure 5:
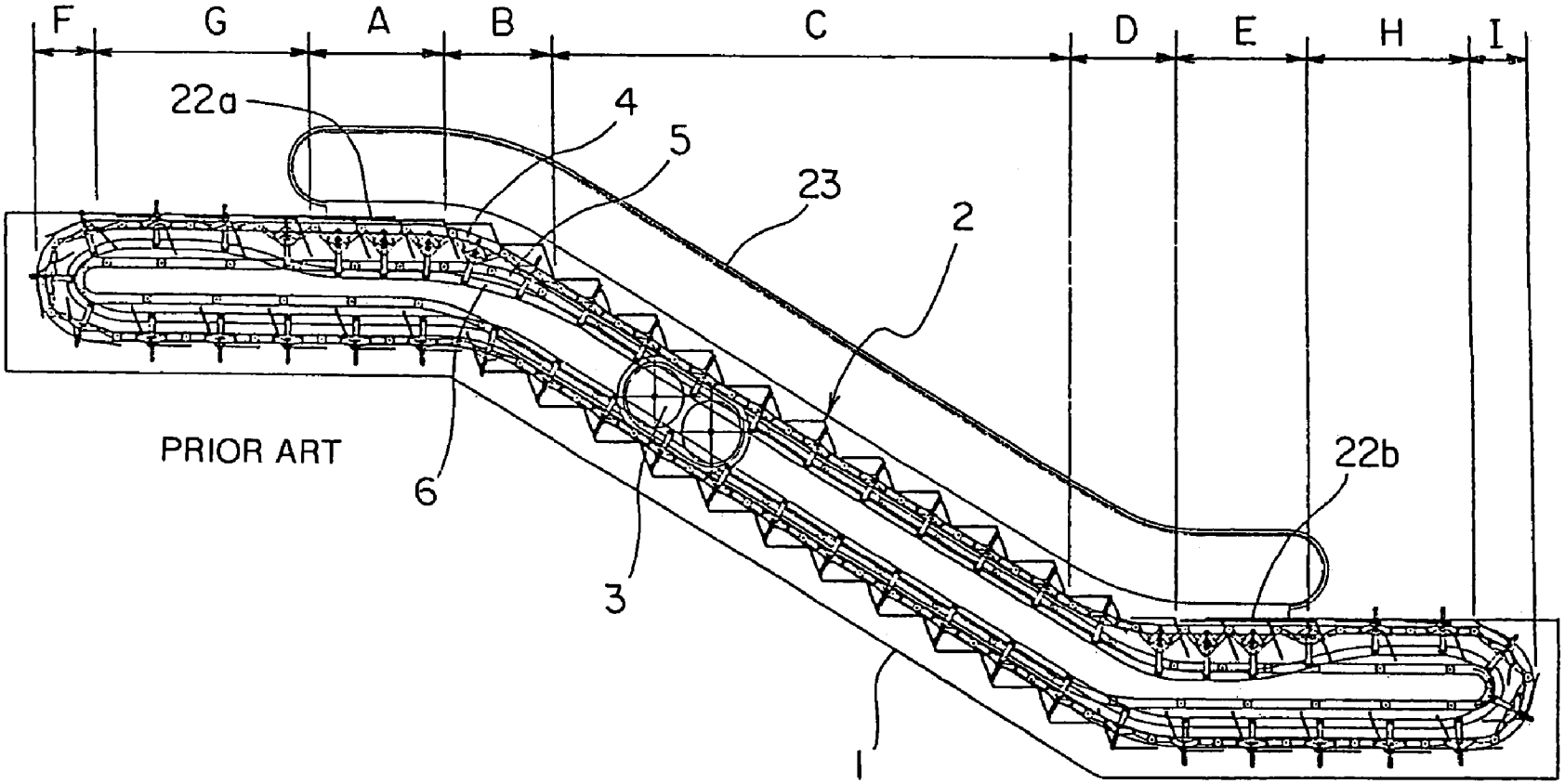
FIG. 5 is a schematic side view showing an example of a conventional escalator with a high speed inclined section.
Figure 6:
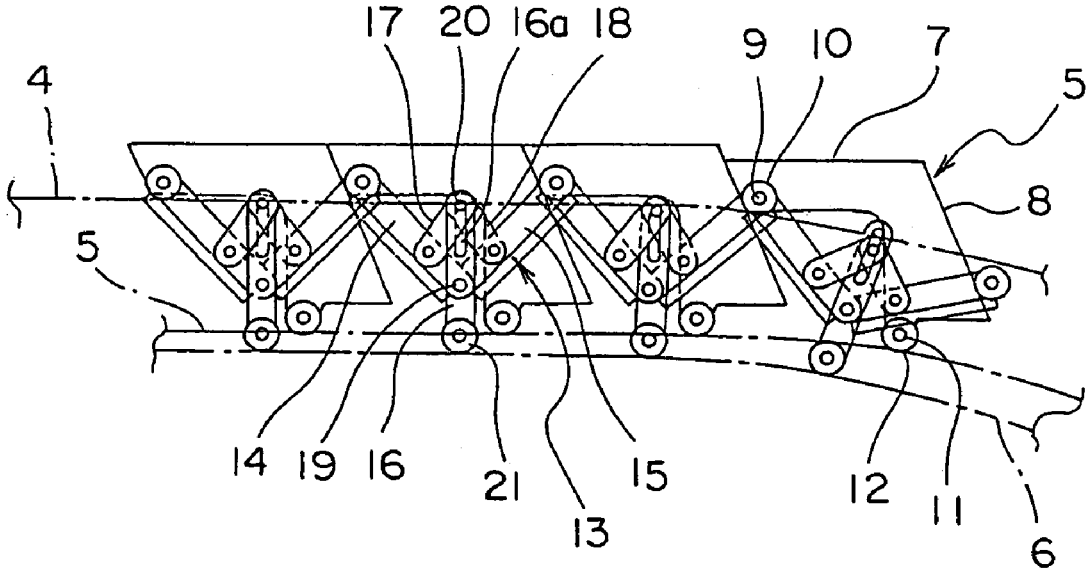
FIG. 6 is a side view showing the portion around the upper landing section A of the escalator of FIG. 5.
Figure 7:
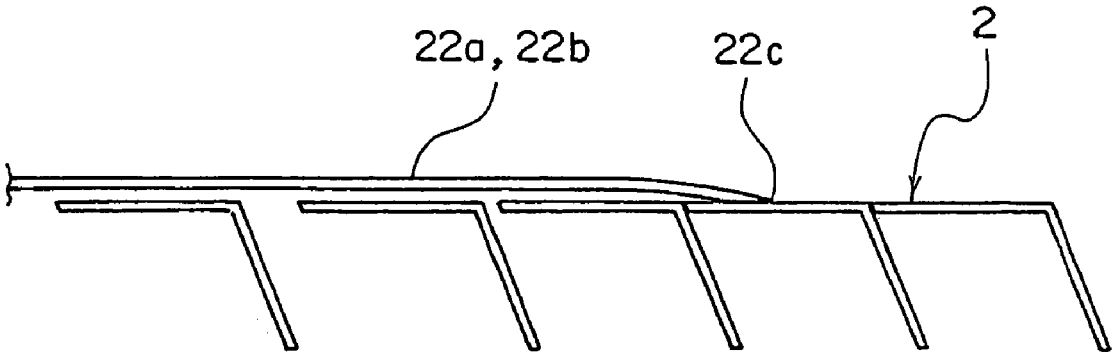
FIG. 7 PRIOR ART
FIG. 7 is an explanatory diagram showing the positional relationship between the landing plate and the steps of FIG. 5.
Figure 8:
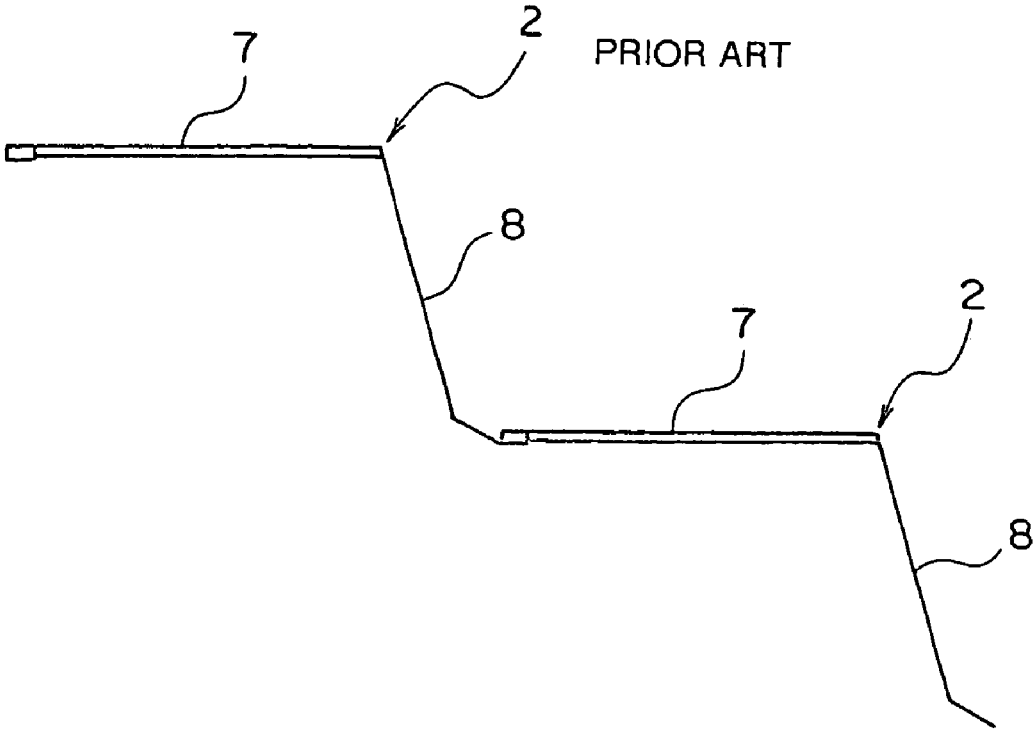
FIG. 8 PRIOR ART
FIG. 8 is an explanatory diagram showing the riser configuration of the steps of FIG. 5.

As in the case of FIG. 5, the loop track for the steps 34 formed by the main tracks 31 has a forward track section, a return track section, an upper reversing section F, and a lower reversing section I. The forward track section of the loop track includes a horizontal upper landing section (upper horizontal section) A, an upper curved section B, an intermediate inclined section (fixed inclination section) C of a fixed inclination angle, a lower curved section D, a horizontal lower landing section (lower horizontal section) E, an upper transition section G, and a lower transition section H.

The intermediate inclined section C is situated between the upper landing section A and the lower landing section E. The upper curved section B is situated between the upper landing section A and the intermediate inclined section C. The lower curved section D is situated between the lower landing section E and the intermediate inclined section C. The upper transition section G is situated between the upper landing section A and the upper reversing section F. The lower transition section H is situated between the lower landing section E and the lower reversing section I.

Above the steps 34 of the upper and lower landing sections A and E, there are arranged a pair of landing plates 22*a* and 22*b*. The landing plates 22*a* and 22*b* are arranged in the floor portions of the upper and lower landing sections A and E so as to cover the steps 34. Arranged upright above the main frame 1 are a pair of moving handrail devices 23. The moving handrail devices 23 are arranged on either side of the steps 34 with respect to the width direction thereof.

Each step 34 has a tread 35 for carrying a passenger, a riser 36 formed by bending the lower end portion of the tread 35, a step link roller shaft 37 extending along the width direction of the tread 35, a pair of step link rollers 38 rotatable around the step link roller shaft 37, a trailing roller shaft 39 extending parallel to the step link roller shaft 37, and a pair of trailing rollers 40 rotatable around the trailing roller shaft 39. The step link rollers 38 roll on the main tracks 31. The trailing rollers 40 roll on the trailing tracks 32.

The step link roller shafts 37 of adjacent steps 34 are connected to each other by a pair of link mechanisms (bending links) 41. Each link mechanism 41 has first and second links 42 and 43.

One end portion of the first link 42 is rotatably connected to the step link roller shaft 37. The other end portion of the first link 42 is provided with a rotatable auxiliary roller 44. The auxiliary roller 44 rolls on the auxiliary track 33. One end portion of the second link 43 is rotatably connected to the middle portion of the first link 42 through a shaft 45. The other end portion of the second link 43 is rotatably connected to the step link roller shaft 37 of the downwardly adjacent step 34.

The first link 42 has a linear first portion 42*a* connected to the step link roller shaft 37, and a linear second portion 42*b* to which the auxiliary roller 44 is mounted. In the middle portion of the first link 42, the second portion 42*b* is fixed to the first portion 42*a* at a predetermined angle. Thus, the first link 42 is bent in the middle portion so as to be spaced apart from the second link 43, exhibiting a V-shaped configuration. It is also possible for the first and second portions 42*a* and 42*b* to be formed as an integral unit.

Through the guiding of the auxiliary roller 44 by the auxiliary track 33, the shape of the link mechanism 41 is changed so as to expand and contract, and the distance between the step link roller shafts 37, that is, the distance between the adjacent steps 34, is varied. In other words, the line of the auxiliary track 33 is designed such that the distance between the adjacent steps 34 is varied.

Further, the step speed changing means of this embodiment has the link mechanism 41, the auxiliary roller 44, and the auxiliary track 33. The moving speed of the steps 34 is varied by the step speed changing means in accordance with the position in the loop track. Further, the step speed changing means is constructed such that, in the forward track section, the moving speed of the steps 34 is changed only in the upper curved section B and the lower curved section D.

Further, in the upper and lower landing sections, where the distance between the step link roller shafts 37 of the adjacent steps 34 is minimum, the portion of the first link 42 from the bent portion to the other end thereof, that is, the second portion 42*b*, extends perpendicularly with respect to the auxiliary track 33.

Figure 4:
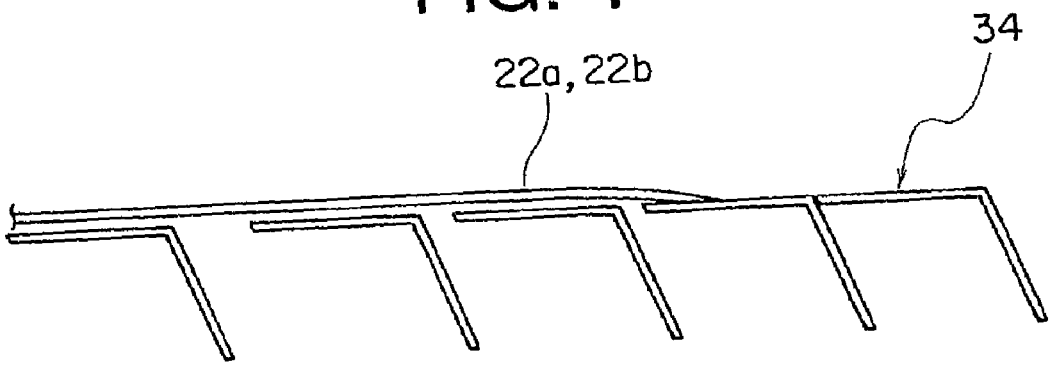
FIG. 4 is an explanatory diagram showing the positional relationship between the landing plate and the steps in the escalator with a high speed inclined section of FIG. 1.

FIG. 4 is an explanatory diagram showing the positional relationship between the landing plate 22*a*, 22*b* and the steps 34 in the escalator with a high speed inclined section of FIG. 1. In the upper and lower landing sections A and E, the distance between the adjacent steps 34 starts to increase immediately after the steps 34 get under the landing plate 22*a*, 22*b*, and the reduction in the distance between the adjacent steps 34 is completed immediately before the steps 34 emerge from under the landing plate 22*a*, 22*b*. That is, the distance between the adjacent steps 34 is large even in the section in which the landing plate 22*a*, 22*b* is positioned above the steps 34 and in which the moving handrail device 23 is arranged.

Next, the operation of this escalator will be described. The adjacent steps 34 are connected to each other by the link mechanism 41, and the distance between the step link roller shafts 37 of the adjacent steps 34 varies according to the angle formed by the first and second links 42 and 43. Further, the angle formed by the first and second links 42 and 43 is varied according to the distance between the main track 31 and the auxiliary track 33. At this time, the attitude of the steps 34 is properly maintained through the guiding of the trailing roller 39 by the trailing track 52.

Figure 2:
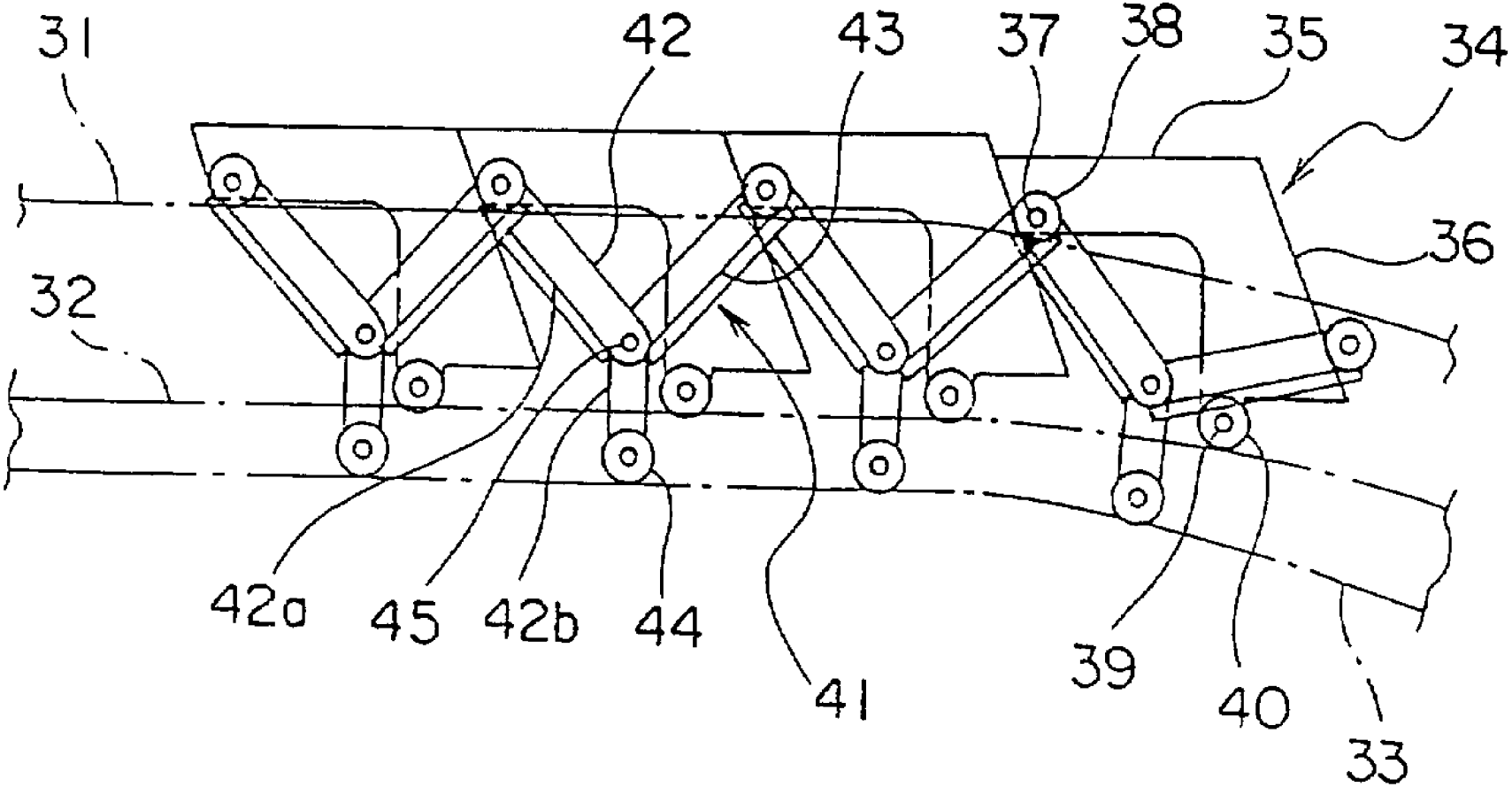
FIG. 2 is a side view showing a main portion of FIG. 1.

As shown in FIGS. 1 and 2, of the forward track section of the loop track for the steps 34, the distance between the step link roller shafts 37 of the adjacent steps 34 is minimum in the upper and lower landing sections A and E. When, from this state, the distance between the main track 31 and the auxiliary track 33 is reduced, the angle formed by the first and second links 42 and 43 increases, and the distance between the step link roller shafts 37 of the adjacent steps 34 increases.

In the intermediate inclined section C, the distance between the main track 31 and the auxiliary track 33 is minimum, and the distance between the step link roller shafts 37 of the adjacent steps 34 is maximum.

The speed of the steps 34 is varied by varying the distance between the step link roller shafts 37 of the adjacent steps 34. That is, in the upper and lower landing sections A and E where passengers get on or off, the above-mentioned distance is minimum, and the steps 34 are moved at low speed. In the intermediate inclined section C, the above-mentioned distance is maximum, and the steps 34 are moved at high speed. In the first link 42 in this condition, the first portion 42*a* and the second link 43 are arranged substantially in a straight line. Further, in the upper and lower curved sections B and D, the distance between the adjacent steps 34 is varied, and the steps 34 are accelerated or decelerated.

In this escalator with a high speed inclined section, the distance between the step link roller shafts 37 is varied by the link mechanism 41 having the first and second links 42 and 43, so that in the link mechanism 41, only one bearing portion, i.e., the one at the connecting portion of the first and second links 42 and 43, suffices. Thus, the construction of the link mechanism 41 can be simplified, making it possible to restrain the influence of play due to production errors and wear in the bearing portion and to reduce errors in the distance between the step link roller shafts 37. Further, by simplifying the link mechanism 41, a reduction in production cost is achieved.

Here, when a tensile force or a compression force is applied between the steps 34, the load is received by the auxiliary roller 44. The force supported by the auxiliary roller 44 is related to the angle formed by the first and second links 42 and 43; in the intermediate inclined section where the first portion 42*a* and the second link 43 are arranged in a straight line, it is substantially only the weight of the first and second links 42 and 43 that is applied to the auxiliary roller 44.

However, as the distance between the step link roller shafts 37 is diminished and the opening angle formed by the first and second links 42 and 43 is reduced, the force applied to the auxiliary roller 44 increases when a tensile/compression force is applied between the steps 34. And, in the upper and lower landing sections, where the distance between the step link roller shafts 37 is minimum, the auxiliary roller 44 receives the greatest force when a tensile/compression force is applied between the steps 34.

In this embodiment, in contrast, in the upper and lower landing sections, the second portion 42*b* to which the auxiliary roller 44 is mounted extends perpendicularly to the auxiliary track 33. Thus, no bending stress is generated in the second portion 42*b*, and only a tensile/compression stress is generated, resulting in a substantial reduction in burden in terms of strength, whereby it is possible to secure a sufficient degree of reliability.

Further, the bending stress generated in the second portion 42*b* is reduced by bending the second portion 42*b* with respect to the first portion 42*a*, and is minimized by arranging the second portion 42*b* at right angles with respect to the auxiliary track 33.

Further, when the link mechanism 41 is used, no protrusion beyond the landing plate 22*a*, 22*b* occurs even if the distance between the steps 34 is increased in the horizontal section, so that the distance between the adjacent steps 34 starts to increase immediately after the steps 34 get under the landing plate 22*a*, 22*b*, and the reduction in the distance between the adjacent steps 34 is completed immediately before the steps 34 emerge from under the landing plate 22*a*, 22*b*. That is, even in the area where the moving handrail device 23 is arranged above, it is possible to increase the distance between the adjacent steps 34. Thus, it is possible to restrain an increase in the length of the upper and lower landing sections A and E, thereby achieving an overall reduction in the escalator size.

Here, when the moving speed of the steps 34 varies, the relative position between a step 34 and an adjacent lower step 34 varies. At this time, the end portion of the tread 35 of the lower adjacent step 34 undergoes change in position along the surface of the riser 36 of the upper step 34. In the forward track section of this embodiment, the moving speed of the steps 34 is varied only in the upper and lower curved sections B and D. Thus, in the forward track section, the relative change in position of the tread 35 of the lower step with respect to the riser 36 of the upper step is completed exclusively in the upper and lower curved sections B and D. Thus, the riser 36 can be formed as a continuous plane or curved surface, thereby achieving a reduction in production cost.

What is claimed is:

1. An escalator with a high speed inclined section comprising:

a plurality of steps, each step having a tread for carrying a passenger, a step link roller shaft, and a step link roller rotatable around the step link roller shaft, the steps being connected together for endless circulating movement of the steps;

a main track for guiding movement of the step link rollers in the endless circulating movement of the steps;

a plurality of link mechanisms, each link mechanism having a first link with a first end portion rotatably connected to the step link roller shaft of one of the steps, and a second link, a first end portion of which is rotatably connected to a middle portion of the first link and a second end portion of which is rotatably connected to the step link roller shaft of an adjacent step, each link mechanism including no more links than the first link and the second link;

a plurality of rotatable auxiliary rollers, each rotatable auxiliary roller being located at a second end of a respective first link; and an auxiliary track for guiding movement of the auxiliary rollers in the endless circulating movement of the steps, wherein the main track is disposed between the treads and the auxiliary track throughout all of the endless circulating movement of the steps.

2. The escalator with a high inclined section according to claim 1, wherein each of the steps includes a riser that is transverse to the tread.

3. An escalator with a high speed inclined section comprising:

a plurality of steps, each step having a tread for carrying a passenger, a step link roller shaft, and a step link roller rotatable around the step link roller shaft, the steps being connected together for endless circulating movement of the steps;

a main track for guiding movement of the step link rollers in the endless circulating movement of the steps;

a plurality of link mechanisms, each link mechanism having a first link with a first end portion rotatably connected to the step link roller shaft of one of the steps, and a second link, a first end portion of which is rotatably connected to a middle portion of the first link and a second end portion of which is rotatably connected to the step link roller shaft of an adjacent step, wherein the first link includes first and second linear portions fixedly joined to each other at the middle portion of the first link, the first and second linear portions forming between them a fixed included angle larger than 90° and smaller than 180°;

a plurality of rotatable auxiliary rollers, each rotatable auxiliary roller being located at a second end of a respective first link; and an auxiliary track for guiding movement of the auxiliary rollers in the endless circulating movement of the steps.

4. The escalator with a high speed inclined section according to claim 3, wherein, when distance between the step link roller shafts of adjacent steps is minimum, the first link, from the middle portion to the second end of the first link, is perpendicular to the auxiliary track.

5. The escalator with a high speed inclined section according to claim 3, wherein a variable angle is formed between the first link and the second link, and distance between the step link roller shafts of adjacent steps varies according to separation between the main track and the auxiliary track.

6. The escalator with a high inclined section according to claim 3, wherein each of the steps includes a riser that is transverse to the tread.

7. An escalator with a high speed inclined section comprising:

a plurality of steps, each step having a tread for carrying a passenger, a step link roller shaft, and a step link roller rotatable around the step link roller shaft, the steps being connected together for endless circulating movement of the steps;

a main track for guiding movement of the step link rollers in the endless circulating movement of the steps;

a plurality of link mechanisms, each link mechanism having a first link with a first end portion rotatably connected to the step link roller shaft of one of the steps, and a second link, a first end portion of which is rotatably connected to a middle portion of the first link and a second end portion of which is rotatably connected to the step link roller shaft of an adjacent step;

a plurality of rotatable auxiliary rollers, each rotatable auxiliary roller being located at a second end of a respective first link;

an auxiliary track for guiding movement of the auxiliary rollers, wherein the main track is disposed between the treads and the auxiliary track throughout all of the endless circulating movement of the steps; and a connecting shaft, wherein the second link is connected to the first link through the connecting shaft, a fixed included angle larger than 90° and smaller than 180° is formed between a first straight line segment connecting a center of the step link roller shaft and a center of the connecting shaft, and a second straight line segment connecting a center of the auxiliary roller and the center of the connecting shaft, a variable angle is formed between the first and the second links, and distance between the step link roller shafts of a adjacent steps varies according to the separation between the main track and the auxiliary track.

8. The escalator with a high inclined section according to claim 7, wherein each of the steps includes a riser that is transverse to the tread.

* * * * *